US005934134A

United States Patent [19]

Codatto

[11] Patent Number: 5,934,134

[45] Date of Patent: Aug. 10, 1999

[54] BENDING PRESS

[75] Inventor: Antonio Codatto, Lonigo, Italy

[73] Assignee: Amada Company, Ltd., Isehara, Japan

[21] Appl. No.: 08/868,380

[22] Filed: Jun. 3, 1997

Related U.S. Application Data

[63] Continuation-in-part of application No. 08/339,011, Nov. 14, 1994, abandoned.

[51] Int. Cl.[6] ..... B21D 5/04; B21D 11/04; B21D 37/04

[52] U.S. Cl. ..... 72/319; 72/446; 72/413; 72/478

[58] Field of Search ..... 72/319, 322, 323, 72/478, 446, 413

[56] References Cited

U.S. PATENT DOCUMENTS

| | | | |
|---|---|---|---|
| 4,532,792 | 8/1985 | Hongo | 72/319 |
| 4,660,402 | 4/1987 | Hongo | 72/323 |
| 4,722,214 | 2/1988 | Hayashi et al. | 72/319 |
| 4,856,315 | 8/1989 | Salvagnini | 72/332 |
| 4,930,332 | 6/1990 | Hongo | 72/319 |
| 5,642,639 | 7/1997 | Codatto | 72/319 |
| 5,775,156 | 7/1998 | De Rossi et al. | 72/319 |

FOREIGN PATENT DOCUMENTS

| | | | |
|---|---|---|---|
| 60-18228 | 1/1985 | Japan | 72/478 |
| 63-207419 | 8/1988 | Japan | 72/478 |
| 1-154822 | 6/1989 | Japan | 72/478 |
| 5-212446 | 8/1993 | Japan | 72/478 |

*Primary Examiner*—David Jones
*Attorney, Agent, or Firm*—Bucknam and Archer

[57] ABSTRACT

A bending press comprises an upper frame (6); a blank holding device (103) mounted on the upper frame, for holding a sheet panel on a member opposed to the blank holding device, the blank holding device including a central member (1), two extremity members (4,4'), and a plurality of additional members (3,3') disposed between the extremity members (4, 4') and the central member (1); a storehouse mounted on an upper section of the upper frame, for storing a plurality of central members, the storehouse including: an elongated carriage (141) supported on an upper section of the upper frame (6) so as to be movable in the lateral direction of the bending press, the elongated carriage extending in the lateral direction and being provided with a plurality of first vertical guides (151) arranged along a longitudinal axis of the elongated carriage, each of the first vertical guides being adapted to engage one of the central members so as to guide the same in the vertical direction, and a support surface (153) provided on the upper frame, for supporting the central members engaged by the first vertical guides so as to be slidable on the support surface in the lateral direction, the support surface being formed with a cutout section for permitting a central member located thereabove to pass through the support surface, the cutout section being formed substantially at the center of the lateral width of the bending press; a transfer device (11) for transferring the central member between the storehouse and the blank holding device, the transfer device including a second vertical guide (157) that extends between the cutout section and the blank holding device, for guiding a central member therealong.

10 Claims, 8 Drawing Sheets

BENDING PRESS

This application is a continuation-in-part of U.S. Ser. No. 08/339,011 filed Nov. 14, 1994, now abandoned.

BACKGROUND OF THE INVENTION

1. Field of the Invention

The present invention relates to a bending press for bending sheet panels and in particular to a bending press in which the lateral length of a blank holding device provided therein is adjustable in accordance with the width of the sheet panel to be bent.

2. Prior Art

Sheet panels which have folded flanges are used very extensively in the manufacture of household electrical appliances, tool cases, furniture and metallic shelving. The manufacture of these sheet panels is carried out with suitable bending presses or folding presses, the main elements of which are an assembly of blades and a blank holding device, the action of which produces desired bending or folding on the planar sheets such as sheet metal fed to the bending press.

At the present state of the art, there are known some bending presses in which a pair of blades are supported, opposite one to the other, by a cutter block shaped as a "C" and movable in the vertical direction with respect to a blank holding device.

In the case in which panels with flanges folded towards the interior are produced, the blank holding device must be capable of undergoing contraction in order to allow the release of the sheet panel from the blank holding device. In addition, there must be the possibility of varying the width of the same blank holding device in accordance with the change of the width of the panels and the profile of the bending to be formed on the panels.

According to the present state of the art, there is known a bending press capable of modifying in a programmed manner the length of the blank holding device (for example, U.S. Pat. No. 4,856,315 and JP 7-112215 A). The variation of the length of the blank holding device is achieved in the conventional apparatuses mainly by varying the number of the suitable segments included therein. The final adjustment of the length of the blank holding device is then carried out, for example, by substitution of the extremity members of the blank holding device. Such conventional press is provided on the side of the blank holding device with two storehouses each containing a plurality of the symmetrically corresponding extremity members and means for carrying out automatic and programmed substitution of the extremity members. The storehouse consists of programmed carriages provided with separation systems which slidable along guides by means of the rotation of screws having the same length as the guides. The screws is placed in motion by suitable motors in the two directions. The motion of the carriages for achieving the substitution of the extremity members must occur contemporaneously and must be synchronized with the contraction of the blank holding device.

The conventional bending press has the drawback that it is functionally limited due to its complexity. An example of such drawback is that the cost of administration and maintenance is increased. The considerable dimension and consequently the space occupied by the conventional apparatuses is another problem. By way of summary, the limitations of the conventional apparatuses are as follows:

1) Two storehouses each containing a plurality of devices are needed, which increase the cost of the bending press and requires considerable space;

2) Excessive machinery for hooking and unhooking the extremity members is needed, which causes mechanical problems and increases the maintenance costs;
3) The change of the extremity members must be carried out only at a fixed vertical position of the blank holding device with respect to the front plate of the apparatus, which is vertically fixed.

SUMMARY OF THE INVENTION

The foregoing problems are solved by means of a bending press in accordance with the present invention.

The bending press according to the present invention has a blank holding device comprising two extremity members which enclose a plurality of additional members and a central member. The central member can be raised and substituted with another central member stored in a storehouse mounted on an upper section of a frame of the bending press. The storehouse is adapted to accommodate a plurality of the central members and is mounted on the upper section so as to be movable in the lateral direction. A transfer device is provided for transferring the central member between the blank holding device and the storehouse. The transfer device is provided with means for delivering a used central member to the storehouse and taking out a new central member from the storehouse. The transfer device includes a moving means that raises and lowers in a programmed and automated manner a central member during the phase of contraction of the blank holding device and eventually substitutes contemporaneously the central member in a single operation.

The foregoing operation is carried out together with the action of two suitable expanding means placed on the sides of the central member in the blank holding device. The expanding means are provided with cylinders acting as arms and slidable on the frame of the bending press and with elastic means for moving and urging the arms along guides supported on the frame. These sliding arms support the expanders each of which is in contact with one of the additional members at each side of the central member, for moving the additional members outwards in the lateral direction.

The function of the expanding means is to move the additional members away from the central member towards the exterior according to a programmed manner. In other words, with the expanding means, the two sets formed by the additional members disposed between the expanders and the extremities are moved away from each other. This is performed for the purpose of permitting the insertion of the central member.

The foregoing operations occur contemporaneously with the eventual re-equipment of the blank holding device by a variation of the number of additional members provided between the central member and the extremity members. This variation is achieved by the action of a pair of programmed carriages. The action of the programmed carriages is contemporaneously carried out with the action of the expanders. Each of the carriages carries a gripping means for the gripping the extremities and a splitting-parceling for parceling the additional members. During its operation, the gripping means is first located at a position in front of the extremities to grip the same. Afterwards the splitting-parceling means moves to the assembly of the additional members and split or parcel of the additional members so that different number of additional members are located between the splitting-parceling means and the central member. The gripping means for gripping the extremities at this stage depose the extremities on the sides of the blank holding device.

The final regulation of the dimension of the blank holding device is carried out by selecting one of the central members from the plurality of the central members stored in the storehouse.

In any event, the minimum length of the blank holding device is achieved by providing the smallest central member and the two lateral expanders as well as the extremities without any other additional member. The maximum length is achieved on the contrary by inserting the central member having the greatest dimension, together with the maximum number of the additional members placed on the both sides between the expanders and the extremities.

BRIEF DESCRIPTION OF THE DRAWINGS

The present invention will be better understood by reference to the attached drawings which illustrate a non-limiting embodiment of the bending press in accordance with the present invention, in which.

DETAILED DESCRIPTION OF THE PREFERRED EMBODIMENT

A description of the apparatus by way of an example of the present invention is believed to be useful for an understanding of the concept of the present invention.

Figure 1:
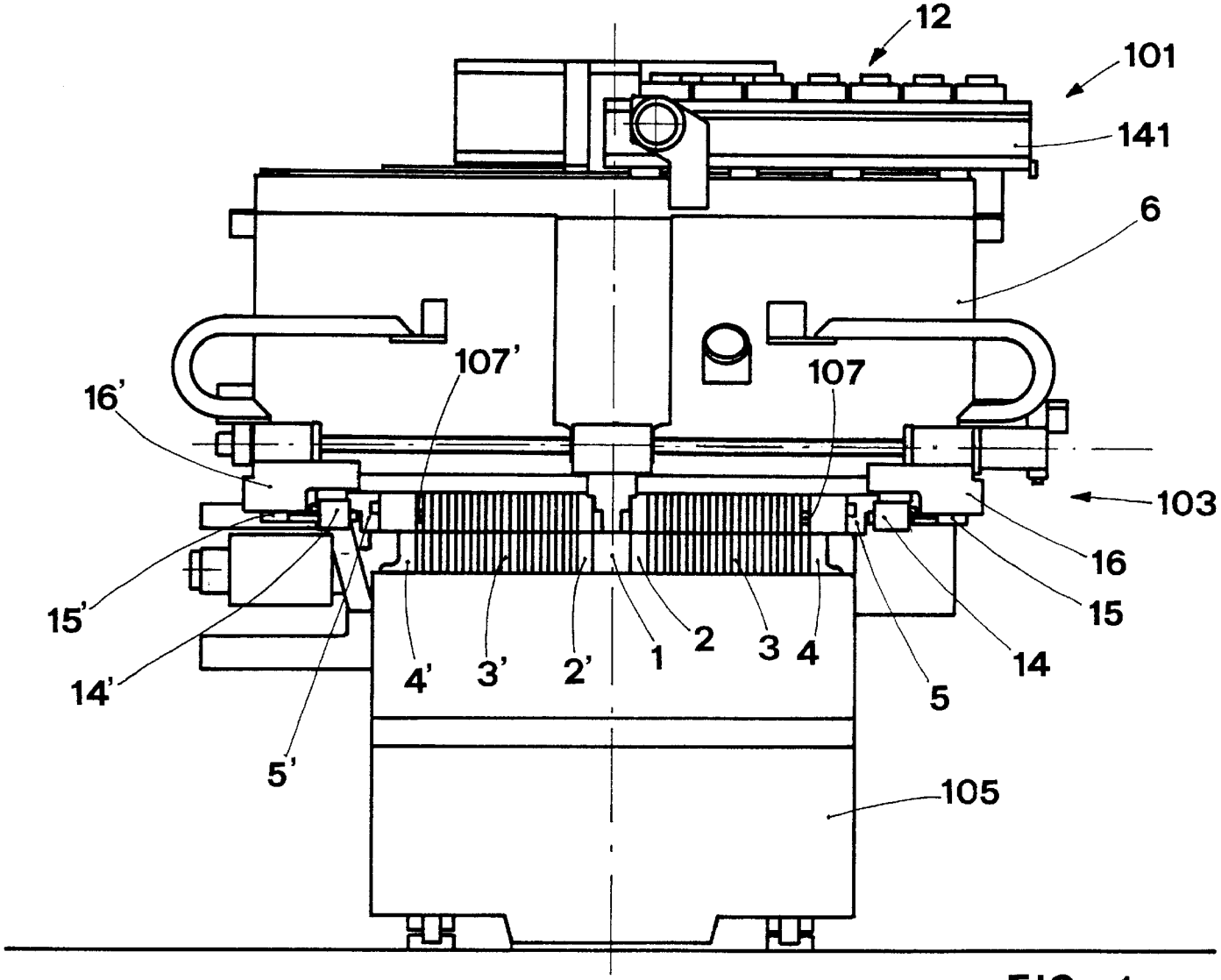
FIG. 1 illustrates an overall view of the bending press in accordance with the present invention.

With reference to FIG. 1, a bending press 101 is provided with an upper frame 6 and a lower frame 105. The upper frame 6 is movable in the vertical direction relative to the lower frame 105. The upper frame 6 carries at its lower end section a blank holding device 103 for holding a sheet panel (not illustrated) on the lower frame 105 during a bending operation.

The blank holding device 103 includes a central member 1, two expansion members 2, 2', a plurality of additional members 3, 3' located at both sides of the central member 1, and two extremity members 4, 4' located at the right and left sides of the additional members 3, 3'. The central member 1 is mounted on the upper frame 6 so as to be movable in the vertical direction, as will described later in detail. The expansion members 2, 2' are supported on the upper frame 6 through movable cylinder 7 acting as a movable arm (see FIG. 2),. which will be described in detail in the following. The additional members 3, 3' are supported through guides 107 (FIG. 2) on the upper frame 6 so as to be movable in the lateral direction. The extremity members 4, 4' are removably supported on the upper frame 6 and adapted to be movable in the lateral direction when mounted on the upper frame 6, as will be described later in detail.

The expansion members 2, 2', the additional members 3, 3' and the extremity members 4, 4' as well as the devices for handling the foregoing members 2, 2', 3, 3', 4, 4' are symmetrically arranged with respect the center of the bending press in the lateral direction. Thus, the arrangements of the foregoing members and devices on one of both sides of the bending press are described in the following for the sake of simplicity.

Figure 11:
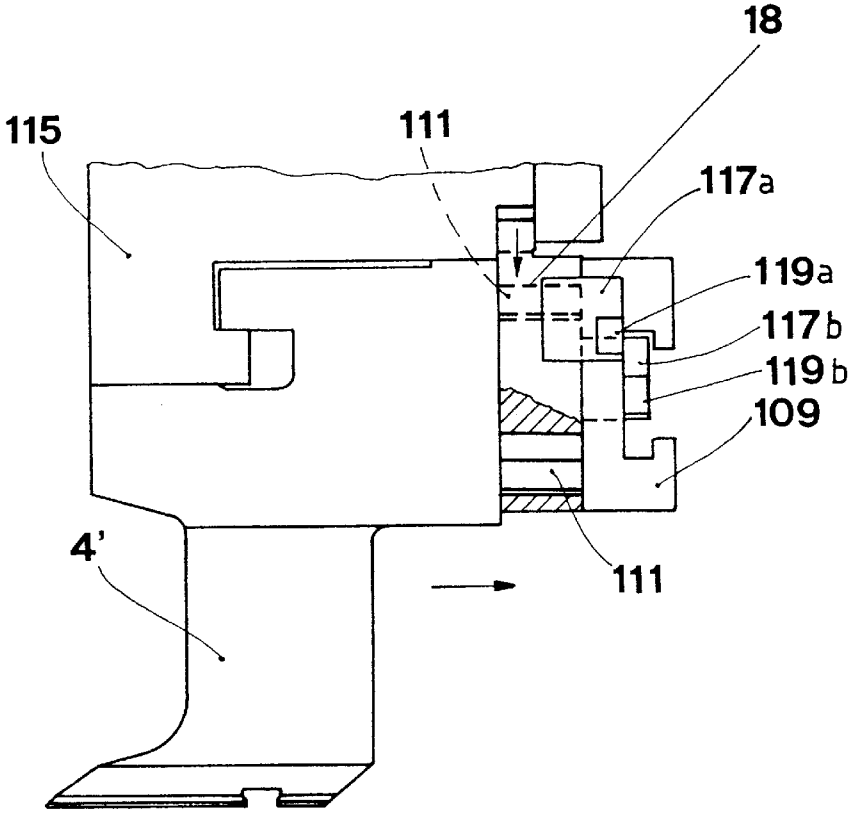
FIG. 11 is an enlarged front view of the extremity member of FIG. 10.
Figure 10:
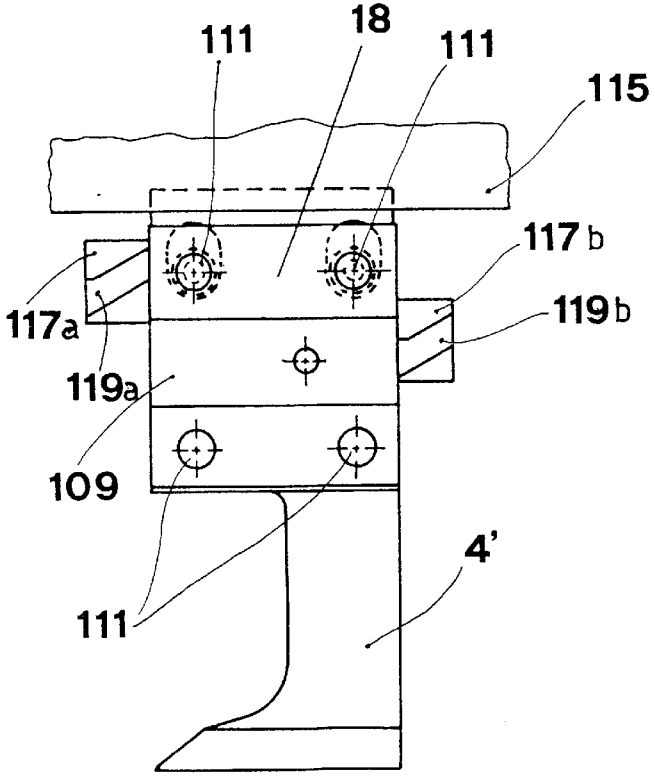
FIG. 10 is an enlarged front view of the extremity member of the blank holding device.

With reference to FIGS. 10 and 11, the left extremity member 4' is removably supported by the lateral guide 115 secured to the upper frame 6. The extremity member 4' is provided with an engaging block 109 and a locking member 18. The engaging block 109 has C-shape in cross section and is secured to the extremity member 4' by suitable bolts 111. The locking member 18 is supported by the bolts 111 to the extremity member 4' so as to be movable in the vertical direction. Thus, when the locking member 18 is in an upper most position, the extremity member is fixed to the lateral guide 115. On the other hand, when the locking member 18 is in a lowermost position, the extremity member 4' is movable in the longitudinal direction (that is in the lateral direction in FIG. 11) and therefore is removable relative to the lateral guide 115. To move the locking member 18 in the vertical direction, a pair of engaging members 107*a*,107*b* each formed with a inclined groove 109*a*, 109*b* are secured to the locking member 18; the function of the engaging members 107*a*, 107*b* are described in detail in the following.

The upper frame 6 further carries a pair of programmed carriages 16,16', which is in the expanded position in FIG. 1. Each of the programmed carriage 16, 16' carries splitting-parceling means 15,15' for splitting or parceling the additional members 3, 3' and gripping means 14, 14' for gripping the extremity member 4, 4'.

Figure 4:
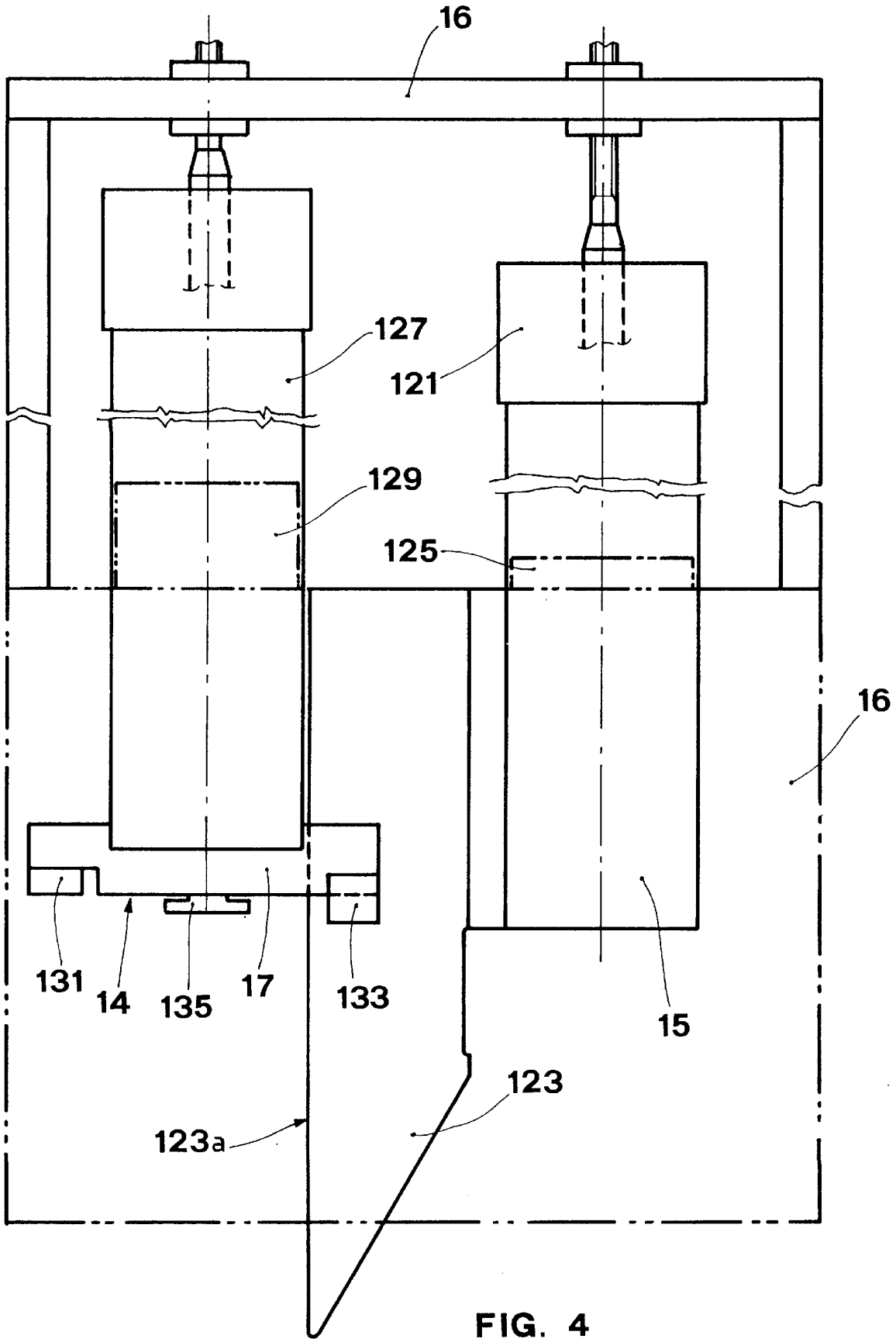
FIG. 4 is a plan view of the programmed carriages provided with the gripping means and the splitting-parceling means.
Figures 5, 6:
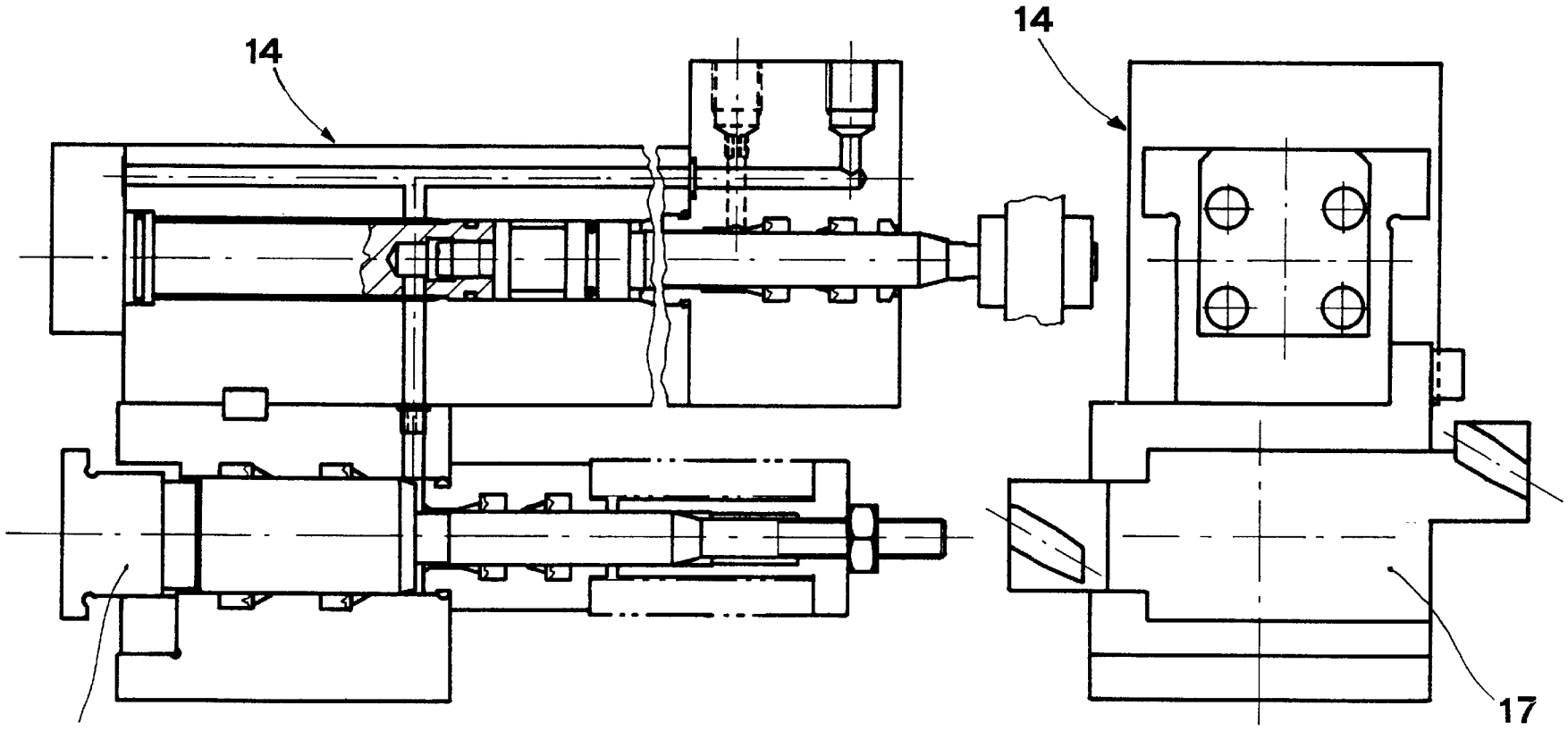
FIG. 5 is a detailed plane view partially in cross section of the gripping means.
FIG. 6 is a side view of the gripping means of FIG. 5.
Figure 8:
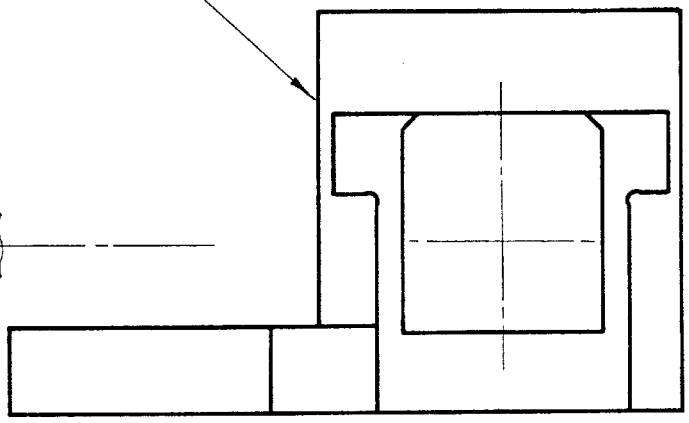
FIG. 8 is a side view of the splitting-parceling means of FIG. 7.
Figure 7:
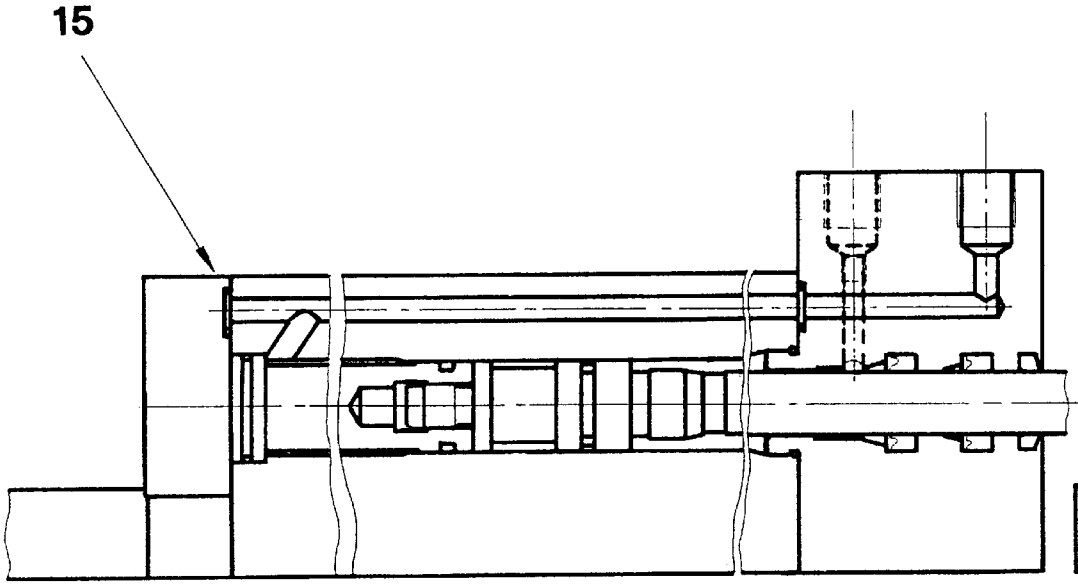
FIG. 7 is a detailed plan view partially in cross section of the splitting-parceling means.
Figure 9:
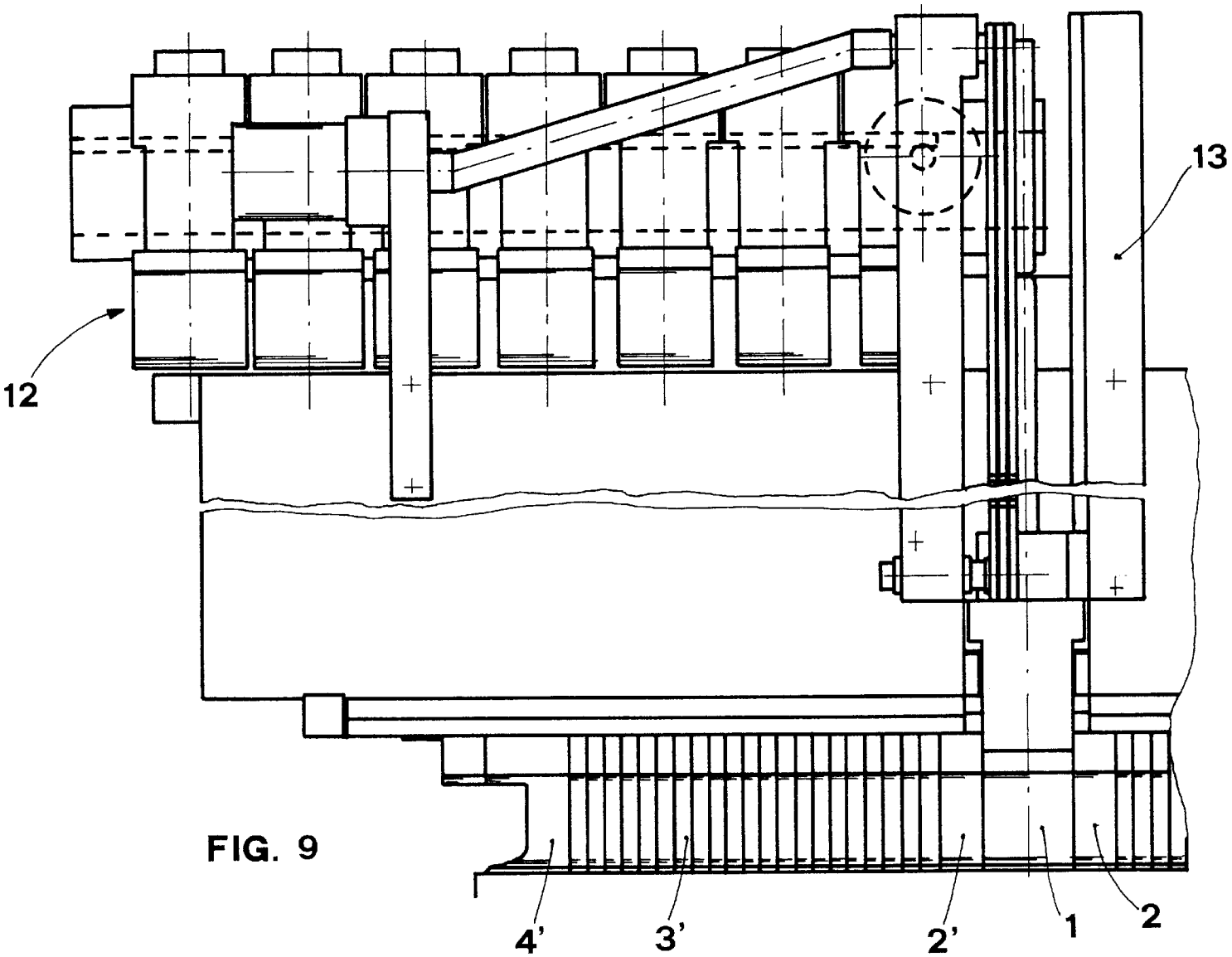
FIG. 9 is a front view partially in cross section of the automated storehouse.

Specifically, as illustrated in FIG. 4, the splitting-parceling means 15, includes a hydraulic or pneumatic cylinder 121 secured to the carriage 16 and a tapered operation section 123 secured to a piston 125 of the cylinder 121. To split or parcel the additional members 3,3' the carriage 16 is first moved in the lateral direction so that the tapered operation section 123 is moved laterally and positioned at a position in front of a desired pair of the additional members 15 where the additional members 15 are to be split or parceled. Then, the cylinder 121 is actuated so that the tapered free end of the operation section 123 is moved toward and inserted between the pair of the additional members to split or parcel the same. Further, the inside surface 123*a* of the operation section 123 is adapted to contact the extremity members 3 so as to urge the same and the additional members 3 toward the central member 1, as described later in detail.

The gripping means 14 for gripping the extremity member 4 includes a hydraulic or pneumatic cylinder 127 secured to the carriage 16, a piston 129 of the cylinder 127 and an operation section 17 secured to the piston 129. Here, it should be noted that the operation section 17 of the gripping means 14 is located at a height position higher than that of the operation section of the splitting-parceling means 15.

The operation section 17 carries first, second and third engaging members 131, 133, 135. The first and second engaging members 131, 133 are adapted to engage the grooves 119*b*, 119*a* of the engaging blocks 117*b*, 117*a* (FIGS. 10 and 11) for moving the lock member 18 in the vertical direction. Specifically, when the carriage 16 is moved rightward in FIG. 10 after the first and second engaging members 131, 133 have engaged the grooves 119*b*, 119*a*, the lock member 18 is moved downward, and vice versa. In order to prevent the extremity member 4 from moving in the lateral direction during this process, the operation section 123 can be arranged on a member (not illustrated) that is movable in the lateral direction relative to the piston 125 of the cylinder 121. With this arrangement, during the lateral movement of the carriage 16 for moving the locking member 18 in the vertical direction, the extremity member 4 can be held at a fixed position by the operation section 123 that can remain at a fixed position during the lateral movement of the carriage 16 because of the lateral movement of the operation section 123 for compensating the lateral movement of the carriage 16.

The third engaging member 135 is adapted to engage the engaging block 109 to remove the extremity member 4 from the upper frame 6 or to mount the extremity member 4 on the upper frame 6. Specifically, after the locking member 18 has been lowered to the lowermost position and the third engaging member 135 has engaged the engaging block 109, when the piston 124 is retracted into and extended from the cylinder 127, the extremity member 4 is moved forward or rearward relative to the upper frame 6 and is removed from and mounted on the upper frame 6. Here, it should be noted that the engaging section 135 is inserted into the engaging groove formed in the C-shaped engaging block 109 from either side of the engaging groove by means of the lateral movement of the carriage 16.

When the length of the panel holding device 103 is to be changed or adjusted, the carriage 16 is first moved laterally so that the gripping 14 is located at a position in front of the extremity member 4. Then, the extremity member 4 is removed from the guide 115 of the upper frame 6 by means of the gripping means 14. Thereafter, the carriage 16 is further moved laterally so that the splitting-parceling means 15 is located at a position where the removed extremity member 4 is inserted between the desired additional members 3 in order to change the length of the panel holding device 103. Then, the splitting-parceling means 15 creates a space, which is sufficient to receive the extremity member 4, between two additional members 3. Then, the removed extremity member 4 supported by the gripping means 14 is inserted into the created space. Thereafter, the carriage 6 is moved to the outermost position, so that the operation section 123 of the guide means 15 move and urges the outer most member of the additional members 3 together with the extremity member 4 and the additional members 3 inside the extremity member 4 toward the central member 1.

Figure 2:
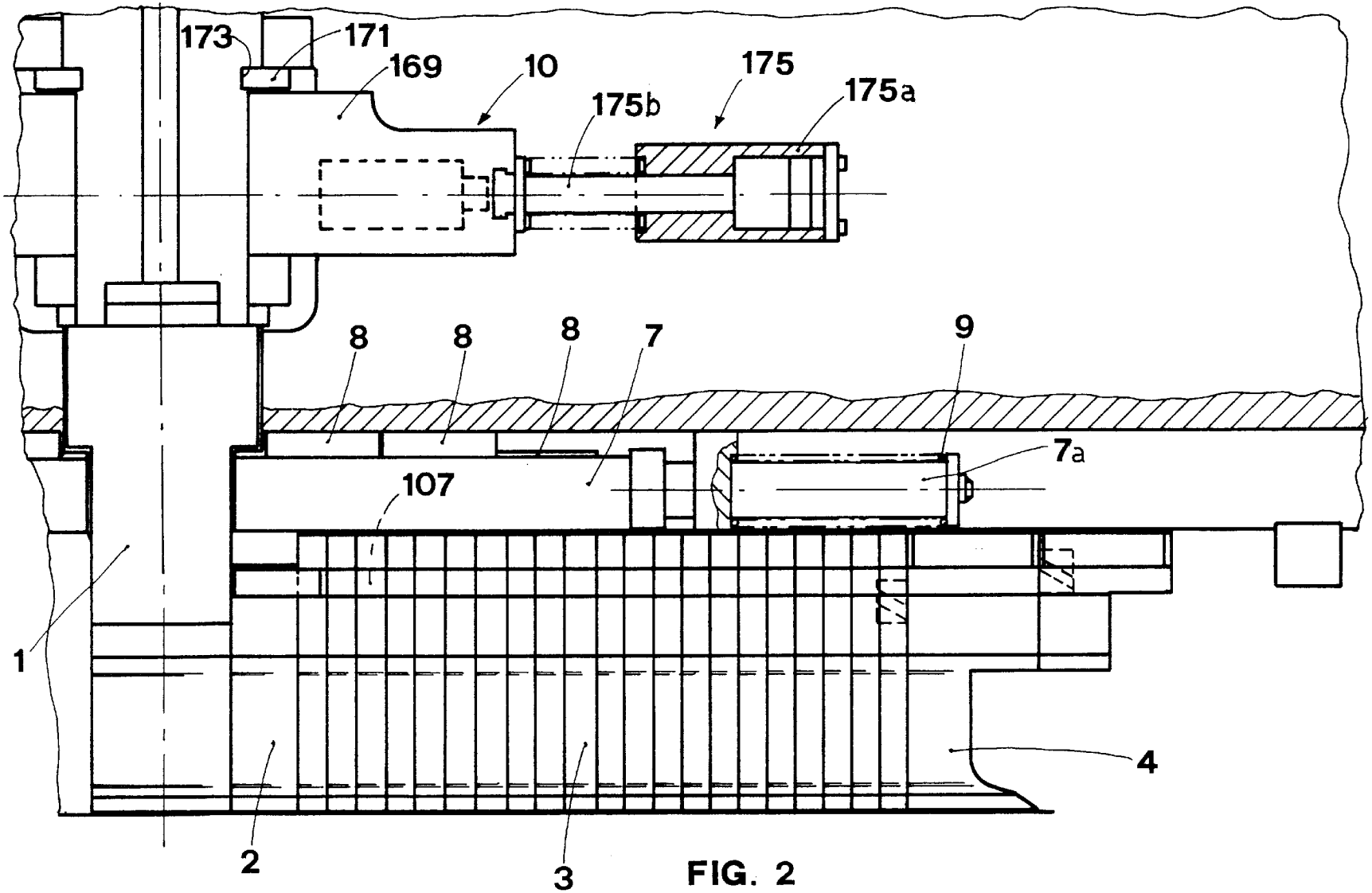
FIG. 2 is an enlarged view of one of the two sides of the blank holding device provided in the bending press of FIG. 1.

With reference to FIG. 2, the expander 2 is secured to a cylinder 7 supported on the upper frame 6 through rolling guides 8 so as to be movable in the lateral direction. A piston 7*a* is slidably inserted into the cylinder 7, and an elastic means 9 is provided between the upper frame 6 and the piston 7*a* to move and urge the piston 7*a* rightward in FIG. 2. Thus, when the piston 7*a* is retracted into the cylinder 7, the expander 2 is moved and urged rightward by the elastic force of the elastic means 9. On the other hand, when the piston 7*a* is extended from the cylinder 7, the elastic means 9 is relaxed and no elastic force of the elastic means 9 is applied to the expander 2, and therefore the expander 2 remains at its position. With this arrangement, when the piston 7*a* is retracted, a space for accommodating the central member 1 is created between the expanders 2, 2'.

Figure 3:
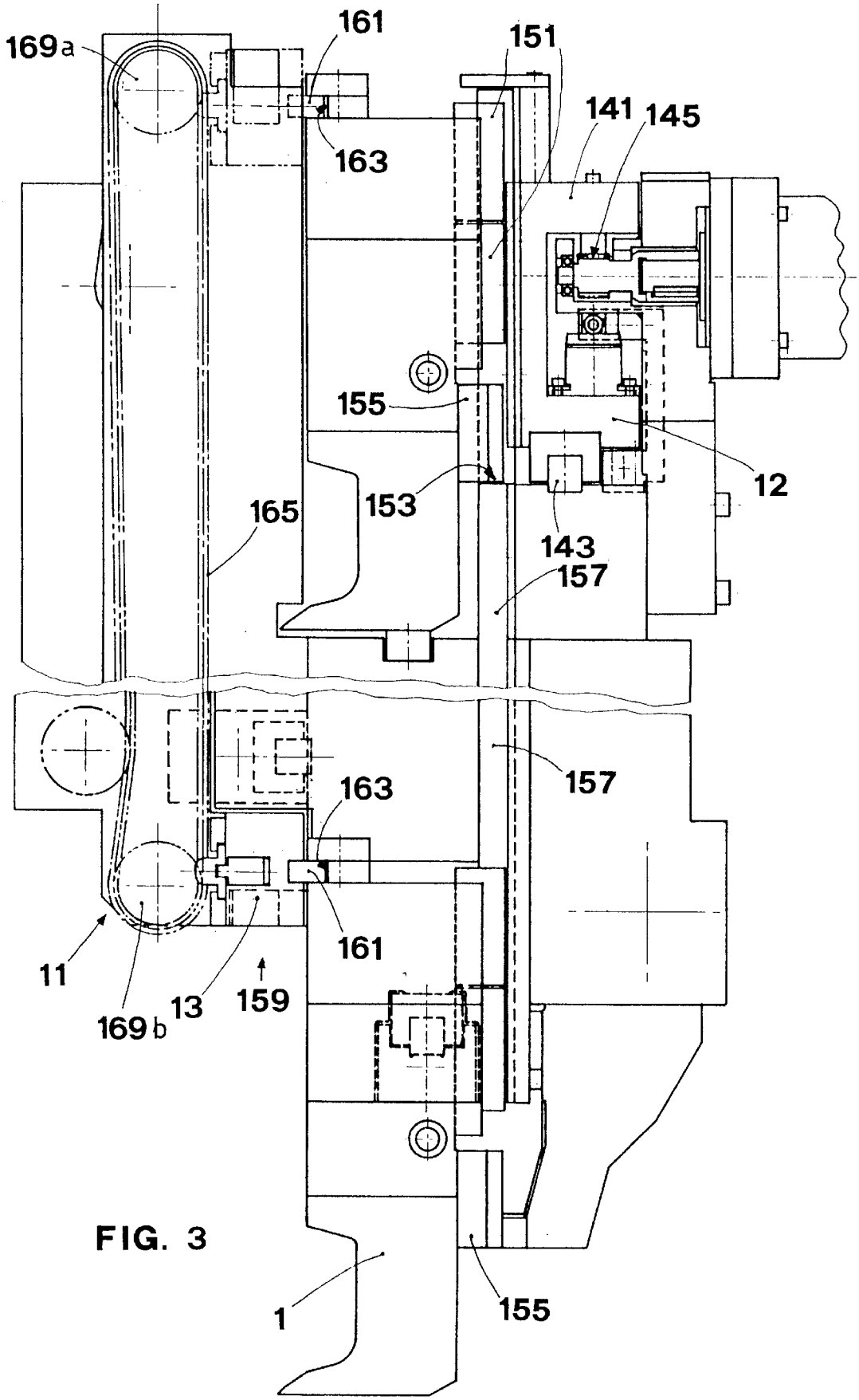
FIG. 3 is a side view partially in cross section of the upper section of the bending press, showing in particular the storehouse and the transfer means.

FIGS. 1 and 3 illustrates a storehouse 12 for storing a plurality of central members 1 and a transfer means for transferring the central member 1 between the storehouse 12 and the blank holding device 103.

The storehouse 12 includes an elongated carriage 141 movable along a lateral guide 143 extending in the lateral direction in FIG. 1. The carriage 141 is provided with a rack 145 that engages with a pinion 147 mounted on the upper frame 6. The pinion 147 is coupled to a motor 149 for rotating the pinion. Thus, the carriage 141 is moved back and forth along the lateral guide 143 by the activation of the motor 149.

The carriage 141 is provided with a plurality of storing sections each for storing each of the central members 1. Each storing section includes vertical linear motion guides 151 secured to the carriage 141 and adapted to guide each of the central members 1 in the vertical direction. The storehouse 12 further includes a support surface 153 formed on the upper frame 6, for supporting the central members 1 stored in the storehouse 12 so as to be slidable on the support surface 153. Specifically, the support surface 153 is adapted to contact the lower surface of a flange 155 of the central members 1 stored in the storehouse 12, so that the central members 1 stored in the storehouse 12 are laterally slidable on the support surface 153. The support surface 153 is formed with a cutout portion (not illustrated) substantially at the center of the upper frame 6 in the lateral direction, so that a central member located at the cutout portion can be transferred toward the blank holding device 103.

A transfer means 11 for transferring the central member 1 between the storehouse 12 and the blank holding device 103 includes a vertical linear motion guide 157 for guiding the central member 1 between the storehouse 12 and the blank holding device 103. Specifically, the vertical guide 157 is secured to the upper frame 6 and extends from the cutout portion of the support surface 153 to the blank holding device 103.

The central member transfer means 11 further includes a moving means 159 or moving the central member 1 in the vertical direction along the vertical guide 157. The central member moving means 159 includes an engaging block 13 that carries a pin 161 for engaging with a lateral groove 163 formed at an upper, tear section of the central member 1. The engaging block 13 is secured to a chain 165 mounted around the teeth wheels 169*a*, 169*b*, one of which is coupled to a motor (not illustrated) for rotating the wheels 169*a*, 169*b*. Thus, a central member 1 engaged by the pin 161 is moved upward and downward by the activation of the motor for the wheels 169*a*, 169*b*.

A central member 1 supported by the pin 161 is replaced with one of the central members 1 stored in the storehouse 12 as follows. First, when the central member 1 supported by the pin 161 is located below the support surface 153, the carriage 141 is moved laterally until one of storing sections where no central member is stored is positioned above the cutout section of the support surface 153. Thus, the vertical guides 151 and 157 are aligned with each other in vertical direction. Then, the block 13 and the pin 161 is moved upward so that the central member 1 held by the pin 161 is located at the height where that central member 1 held by the pin 161 is horizontally aligned with the central members 1 carried by the carriage 141 and engages with the guide 151. Thereafter, the carriage 141 is again moved laterally so that the central member 1 originally held by the pin 161 is moved laterally by the guide 151 and leaves from the pin 161, and a new central member is brought to the position of the pin 161. Here, it should be noted that the pin 161 can easily pass through the lateral groove 163 in the lateral direction because the lateral groove 163 extends from one side to the other in the lateral direction of the upper, rear portion of the central member.

The new central member 1 supported by the pin 161 is then moved towards the blank holding device 103 by the actuation of the chain 165 and the downward movement of block 13.

As described above, when the central member 1 is inserted between the expanders 2, 2' of the blank holding device 103, the a pair of pistons 9 are retracted into respective cylinders; thus, the expanders 2, 2' are separated, by means of the elastic force from the elastic means 9, away from each other to create a space between the expanders 2, 2' for receiving the central member 1. Then, once the central member 1 is inserted between the expanders 2, 2', the foregoing pistons 9 are moved to the extended position, so that the elastic means are relaxed and the expansion members 2, 2' remains at their positions. Then, in order to move the expansion members 2, 2', the additional members 3, 3' and the extremity members 4, 4' toward the central member 1, the operation sections 123 of the splitting-parceling means 15, 15' are placed onto the outer side surfaces of the additional members located at the outer most lateral positions of the blank holding device 103, and the carriage 16, 16' are moved and urged toward the central member 1.

FIG. 2 illustrates means 10 for holding the central member 1 inserted between the expansion members 2, 2'. Specifically, the holding means 10 includes a holding member 169 for engaging the both sides of the central member 1 and a cylinder means 176 for moving the holding member 169 toward and away from the central member 1. Specifically, the holding member 169 is provided with a replaceable engaging section 171 for engaging a side groove 173 formed in the side surface of the central member 1. The cylinder means 176 includes a cylinder 175*a* secured to the upper frame 1 and a piston 175*b* secured to the holding member 169. With this arrangement, the central member 1 inserted between the expansion members 2, 2' is prevented from moving upward during the bending operation. When the central member 1 is to be moved upward for the replacement, the engagement of the engaging section 171 against the groove 173 is released by the retraction of a piston 175*b* into the cylinder 175*a*.

In the foregoing, each of the additional members has for example substantially the same width, which is for example about 20 mm, and the widths of the central members 1 stored in the storehouse 12 are, for example, 110 mm, 115 mm, 120 mm, 125 mm, 130 mm, 135 mm, 140 mm. Thus, the initial adjustment of the width of the blank holding device 103 is preferably carried out by adjusting the number of the additional members 3, 3' inserted between the extremity members 4, 4'. And the final adjustment of the width of the blank holding device 103 is carried out by selecting one of a desirable central member 1 from the central members stored in the storehouse 12.

The foregoing arrangements of the storehouse 12 and the central member transferring means 11have advantages such as follows:

1) Since the storehouse 12 is located above the upper frame 6, and the central member 1 is transferred between the storehouse 12 and the blank holding device behind the upper frame 6, when a manipulator for is handling a sheet metal is provided in front of the bending press, the manipulator can come very close to the blank holding device for precise and secure gripping of the workpiece.

2) Since the central member 1 in the blank holding device can be changed with a new one by means of the lateral movement of the carriage 141 and the vertical movement of the block member 13, the replacement of the central member 1 is carried out simply and quickly.

What is claimed is:

1. A bending press for bending sheet panels comprising:

an upper frame (6);

a blank holding device (103) mounted on the upper frame, for holding a sheet panel on a member opposed to the blank holding device, the blank holding device including a central member (1), two extremity members (4,4'), and a plurality of additional members (3,3') disposed between the extremity members (4,4') and the central member (1);

a storehouse mounted on an uppermost part of the upper frame, for storing a plurality of central members, the storehouse including:

an elongated carriage (141) supported on the uppermost part of the upper frame (6) so as to be movable in a lateral direction of the bending press, the elongated carriage extending in said lateral direction and being provided with a plurality of first vertical guides (151) arranged along a longitudinal axis of the elongated carriage, each of the first vertical guides being adapted to engage one of the central members so as to guide the same in a vertical direction, and a support surface (153) provided on the upper frame, for supporting the central members engaged by the first vertical guides so as to be slidable on the support surface in the lateral direction, the support surface being formed with a cutout section for permitting a central member located thereabove to pass through the support surface, the cutout section being formed substantially at the center of the lateral width of the bending press;

a transfer device (11) for transferring the central member between the storehouse and the blank holding device, the transfer device including a second vertical guide (157) that extends between the cutout section and the blank holding device, for guiding a central member therealong.

2. The bending press according to claim 1, wherein said bending press has a front and a rear, said sheet panels are fed in the front of said bending press, and each of the central members is formed with a lateral groove (163) at a rear section thereof at the rear of said bending press, and the transferring means includes a moving device for moving a central member along the second vertical guide between the storehouse and the blank holding device, the moving device including a pin (161) for engaging the lateral groove.

3. The bending press according to claim 2, wherein said press has a center and an exterior, each central member has two sides and said blank holding device comprises two additional lateral expansion members (2,2') disposed on both sides of said central member (1), and said two lateral expansion members are adapted to move said additional members (3,3') away from the center towards the exterior.

4. The bending press according to claim 3, further comprising means for moving the expansion members away from said center towards the exterior, the expansion member moving means including:

cylinders (7) supported by the upper frame so as to be slidable in the lateral direction, an end of each cylinder being secured to each of the expansion members;

pistons (7*a*) provided in the cylinders (7) so as to be slidable relative to the cylinders (7); and elastic means (9) provided between the upper frame and the piston, for urging the piston from the center towards the exterior.

5. The bending press according to claim 4, further comprising a central member holding means (10) for holding the central member so as to prevent the central member from moving upwardly during a bending operation, the central member holding means including holding members adapted to engage both sides of the central member and a cylinder means (175) for moving the holding members toward and away from the central members.

6. A bending press having a lateral width, comprising:

an upper frame (6) and a lower frame (105), said upper frame having an upper section which is movable in the vertical direction and has a lower end section;

a blank holding device (103) mounted on said upper frame, for holding a sheet panel on a member opposed to the blank holding device, the blank holding device including a central member (1), two extremity members (4,4') and a plurality of additional members (3,3'), said central member having two sides, said additional members (3,3+) being located at said sides of the central member, said additional members having a right and a left side, said extremity members being located at the right and left side of said additional members, said central member (1) being mounted on said upper frame (6) and being movable in the vertical direction;

a storehouse mounted on said upper section of said upper frame for storing a plurality of central members, the storehouse including:

an elongated carriage (141) supported on said upper section of the upper frame (6) so as to be movable in a lateral direction of the bending press, the elongated carriage extending in said lateral direction and being provided with a plurality of first vertical guides (151) arranged along a longitudinal axis of the elongated carriage, each of the first vertical guides being adapted to engage one of the central members so as to guide the same in said vertical direction, and a support surface (153) provided on said upper frame for supporting the central members engaged by the first vertical guides so as to be slidable on the support surface in said lateral direction, the support surface being formed with a cutout section for permitting a central member located thereabove to pass through said support surface, the cutout section being formed substantially at the center of the lateral width of the bending press;

a transfer device (11) for transferring the central member between said storehouse and said blank holding device, the transfer device including a second vertical guide (157) which extends between the cutout section and the blank holding device, for guiding a central member therealong.

7. The bending press according to claim 6, wherein each of said central members is formed with a lateral groove (163), each of said central members having an upper rear portion, said lateral groove extending from one side to the other in the lateral direction of said upper rear portion of said central members and the transfer device includes a moving device for moving a central member along said second vertical guide between said storehouse and said blank holding device, the moving device including a pin (161) for engaging said lateral groove.

8. The bending press according to claim 7, wherein said blank holding device comprises two additional lateral expansion members (2,2') disposed on both sides of said central member (1), and said two lateral expansion members are adapted to move said additional members (3,3') outwardly in the lateral direction.

9. The bending press according to claim 8, further comprising means for moving said expansion members outwardly in the lateral direction, the expansion member moving means including:

cylinders (7) supported by the upper frame so as to be slidable in the lateral direction, each of said cylinders having an end, said end of each cylinder being secured to each of the expansion members;

pistons (7*a*) provided in the cylinders (7) so as to be slidable relative to said cylinders (7); and elastic means (9) located between said upper frame and said piston, for urging the piston from the center towards the exterior.

10. The bending press according to claim 9, further comprising a central member holding means (10) for holding said central member so as to prevent the central member from moving upward during a bending operation, the central member holding means including holding members (169) adapted to engage both sides of said central member and cylinder means (175) for moving the holding members toward and away from the central members.

* * * * *